US005808556A

United States Patent [19]

Nelson et al.

[11] Patent Number: 5,808,556

[45] Date of Patent: Sep. 15, 1998

[54] SMOKE/FIRE DETECTOR

[75] Inventors: Wayne A. Nelson, Maynard, Mass.; John S. Margosiak, New Ipswich, N.H.

[73] Assignee: Simplex Time Recorder Company, Gardner, Mass.

[21] Appl. No.: 764,757

[22] Filed: Dec. 12, 1996

[51] Int. Cl.[6] ..... G08B 23/00

[52] U.S. Cl. ..... 340/693; 340/628; 361/740; 439/537

[58] Field of Search ..... 340/693, 577, 340/578, 579, 584, 586, 587, 588, 589, 590, 628, 629, 630, 505, 514; 439/861, 857, 78, 537, 685; 361/740, 731–733, 822–824

[56] References Cited

U.S. PATENT DOCUMENTS

| | | | |
|---|---|---|---|
| 4,140,361 | 2/1979 | Sochor | 339/258 P |
| 4,230,383 | 10/1980 | Burnstein et al. | 339/17 R |
| 4,451,109 | 5/1984 | Inoue | 439/258 S |
| 4,720,276 | 1/1988 | Takahashi | 439/861 |
| 4,778,231 | 10/1988 | Seidler et al. | 439/857 |
| 4,790,764 | 12/1988 | Kawaguchi et al. | 439/78 |
| 4,887,073 | 12/1989 | Nakao et al. | 340/693 |
| 4,952,178 | 8/1990 | Beer | 439/856 |
| 5,710,541 | 1/1998 | Stanley et al. | 340/628 |

*Primary Examiner*—Nina Tong
*Attorney, Agent, or Firm*—Fish & Richardson P.C.

[57] ABSTRACT

A smoke/fire detector assembly having a base section with electrical contacts and a removable/attachable sensor section having corresponding electrical contacts. Each one of the electrical contacts is adapted to electrically contact a corresponding one of the base section electrical contacts. Each one of the electrical contacts has a threaded hole formed therein to receive an electrical contact screw. The hole has a projecting rim disposed about a peripheral portion. The base section has a plurality of recessed pocket formed therein for a corresponding one of the plurality of base section electrical contacts. Each one of the pockets has a pair of opposing sidewalls, a platform, and a resilient tongue-like member protruding into a region between the opposing sidewalls. Upper surfaces of the platform and the tongue-like member are disposed in a common plane spaced from the bottom portions of the sidewalls to provide a channel therebetween. When engaged by a corresponding one of the electrical contacts, the tongue-like member is configured to depressed downward enabling side edge portions of the electrical contact to slide within the channel and to urge the contact upward against the bottom portions of the sidewalls. When the electrical contact is in the channel, the tongue-like member urges the electrical contact upward against the bottom portions of the sidewalls it snaps behind the rim with an audible click and securely locks the electrical contact into place in the channel.

4 Claims, 13 Drawing Sheets

SMOKE/FIRE DETECTOR

RELATED APPLICATIONS

This is related to patent application Ser. No. 08/511,019, filed Aug. 3, 1995, now is patented as U.S. Pat. No. 5,710,541, inventors Lawrence G. Stanley and Wayne A. Nelson, assigned to the same assignee as the present invention.

BACKGROUND OF THE INVENTION

This invention relates generally to smoke/fire detectors and more particularly to smoke/fire detectors having a base section and removable sensor section.

As is known in the art, one type of smoke/fire detector is made up of a base section and a removable sensor section. The base section is adapted for mounting to a ceiling, wall or other building structural member and includes electrical terminals for enabling electrical connection to the building wiring to provide electrical power to the detector and smoke/fire detection signals to a remotely located station, for example.

The sensor section includes the smoke/fire detection element, such as an ionization, photo-optical or heat sensor. The sensor section is removable from the base in order to replace one type of sensor with another type, or to replace the sensor when it becomes defective. Thus, each sensor section/base section pair must be constructed to provide for both mechanical and electrical removable/attachable interconnection. Further, in some countries, each electrical interconnection is required to use a bifurcated contact; that is, when one electrical contact is to engage, or mate with another electrical contact, one of the contacts must make physical contact with at least two points of the other, mating electrical contact. Thus, each base section electrical contact, for example, must make physical contact with two points on each corresponding sensor section electrical contact. While the two contact points may be on one surface of the mating contact, improved mechanical stability results when the two contact points are on opposing surfaces of the mating contact.

In one base section/detector section arrangement, the base section includes a pair of separate electrical contacts for engagement with points on opposite surfaces of a corresponding sensor section electrical contact. Each one of the pair of electrical contacts of the base section is a stamped, single piece having a relatively large mounting portion which terminates into an elongated, cantilevered finger-like contact. The mounting portions of the pair of contacts are encapsulated into the plastic, generally disk shaped, base section and are electrically connected to a common screw fixture also encapsulated into the base section. A screw, threaded into the screw fixture, provides an electrical terminal for securing an electrical wire which provides power to, or receives sensor signals from, the sensor section. The sensor section electrical contact is adapted to mate, and contact, with the pair of base electrical contacts and has opposing surfaces which are disposed in planes parallel to the base. The distal ends of the finger-like contacts of the pair of base electrical contacts extend in opposing, vertically spaced directions parallel to the surface of the base section and are configured to engage the opposing surfaces of the corresponding sensor section electrical contact when the sensor electrical contact is inserted into the space between the corresponding pair of finger-like base section electrical contacts. The engagement provides electrical connection between the base section pair of contacts and the sensor section contact, and also provides a mechanical inter-lock between the base section and the sensor section.

SUMMARY OF THE INVENTION

In accordance with the present invention, a structure is provided for an electrical contact. A recessed pocket is formed in the structure. The pocket has a pair of opposing sidewalls, a platform, and a resilient tongue-like member protruding into a region between the opposing sidewalls. Upper surfaces of the platform and the tongue-like member are disposed in a common plane spaced from the bottom portions of the sidewalls to provide a channel therebetween. When engaged by an electrical contact, the tongue-like member is adapted to be depressed downward enabling side edge portions of the electrical contact to slide within the channel. The tongue-like member is configured and arranged to urge the contact upward against the bottom portions of the sidewalls with the tongue-like member snapping behind a projection from a bottom of the electrical contact producing an audible click and securely locking the electrical contact into place in the channel.

In a preferred embodiment, the electrical contact has a hole formed therein. The hole has a rim disposed about a peripheral portion of the hole to provide the projection. An edge portion of the tongue-like member is adapted to engage a portion of the rim to secure the electrical contact in the channel.

In accordance with another feature of the invention, a smoke/fire detector assembly is provided. The detector assembly includes a base section having a plurality of electrical contacts and a removable/attachable sensor section having a corresponding plurality of electrical contacts. Each one of the sensor section electrical contacts is adapted to electrically contact a corresponding one of the base section electrical contacts. Each one of the base section electrical contacts has a hole formed therein. The hole has a projecting rim disposed about its periphery for receiving an electrical contact screw. The base section has a plurality of recessed pockets formed therein. Each one of the pockets has disposed therein a corresponding one of the plurality of base section electrical contacts. Each one of the pockets has a pair of opposing sidewalls, a platform, and a resilient tongue-like member protruding into a region between the opposing sidewalls. Upper surfaces of the platform and the tongue-like member are disposed in a common plane spaced from the bottom portions of the sidewalls to provide a channel therebetween. When engaged by a corresponding one of the base section electrical contacts, the tongue-like member is configured to depressed downward enabling side edge portions of the electrical contact slide within the channel. The tongue-like member is configured and arranged to urge the electrical contact upward against the bottom portions of the sidewalls. The tongue-like member is configured to snap behind the rim with an audible click and securely lock the electrical contact into place in the channel.

BRIEF DESCRIPTION OF THE DRAWING

FIG. 3 being a side elevation view; FIG. 4 being a top view; FIG. 5 being a front elevation view; and, FIG. 6 being a perspective view;

FIG. 9 being a side elevation view; FIG. 10 being a top view; FIG. 11 being a front elevation view; and, FIG. 12 being a perspective view;

FIG. 15 being a side elevation view; FIG. 16 being a top view; FIG. 17 being a front elevation view; and, FIG. 18 being a perspective view;

FIG. 19 being a cross sectional elevation view of the pocket; FIG. 20 being a top plan view of the pocket, the cross section of FIG. 19 being along line 19—19 in FIG. 20; and FIG. 21 is a bottom plan view of the pocket;

FIG. 22 being a side elevation view; FIG. 23 being a top view; FIG. 24 being a front elevation view; and, FIG. 25 being a perspective view;

FIG. 26 being a cross sectional elevation view; FIG. 27 being a top plan view, the cross section of FIG. 26 being along line 26—26 in FIG. 27; and FIG. 28 being a bottom view;

FIG. 29 being a cross sectional elevation view; and FIG. 30 being a top plan view, the cross section of FIG. 29 being along line 29—29 in FIG. 30; and FIG. 31 being a bottom view.

DESCRIPTION OF THE PREFERRED EMBODIMENTS

Figure 1:
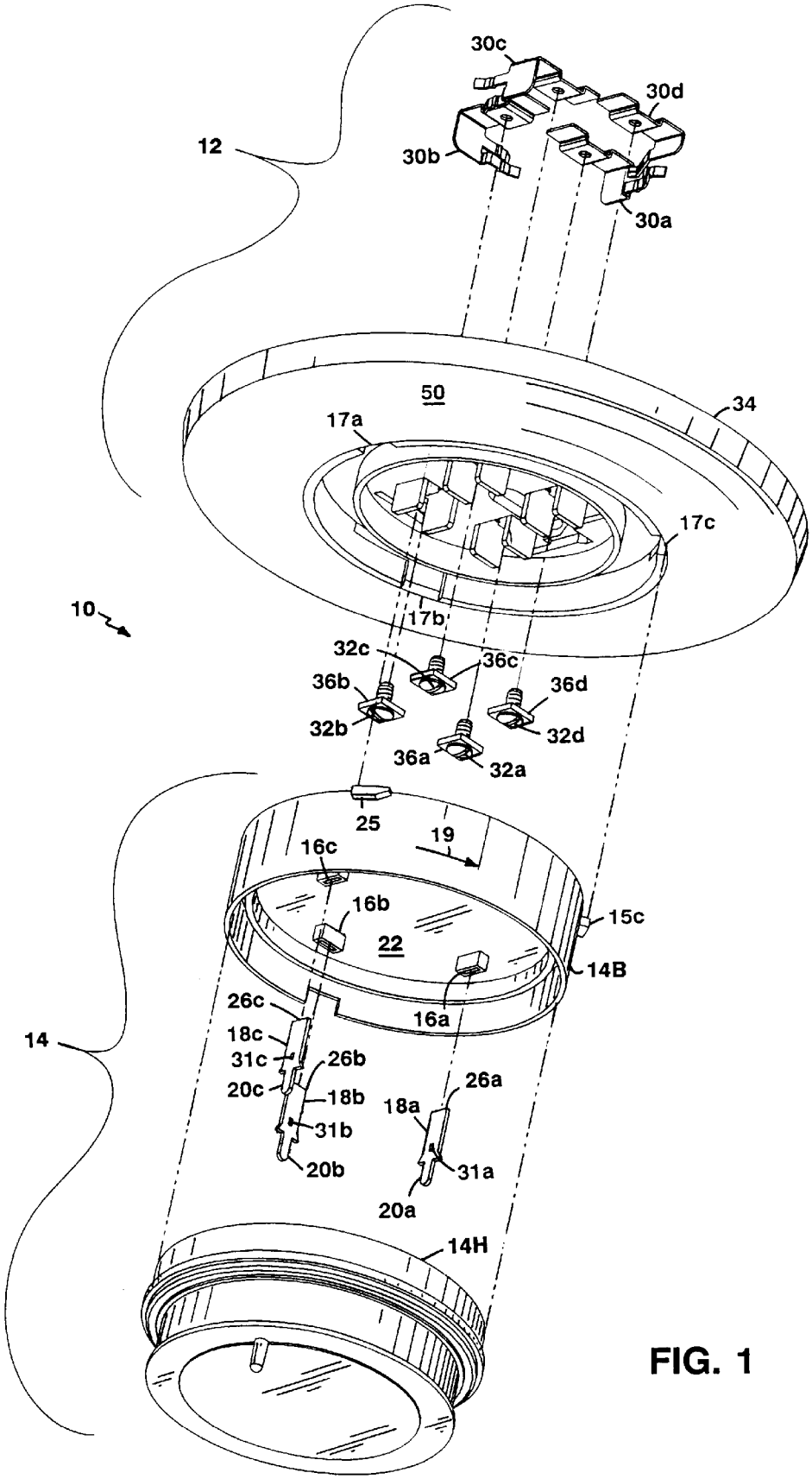
FIGS. 1 and 2 are perspective, exploded views of a smoke/fire detector, FIG. 1 showing the detector from one perspective and FIG. 2 showing the detector from an opposite perspective.
Figure 2:
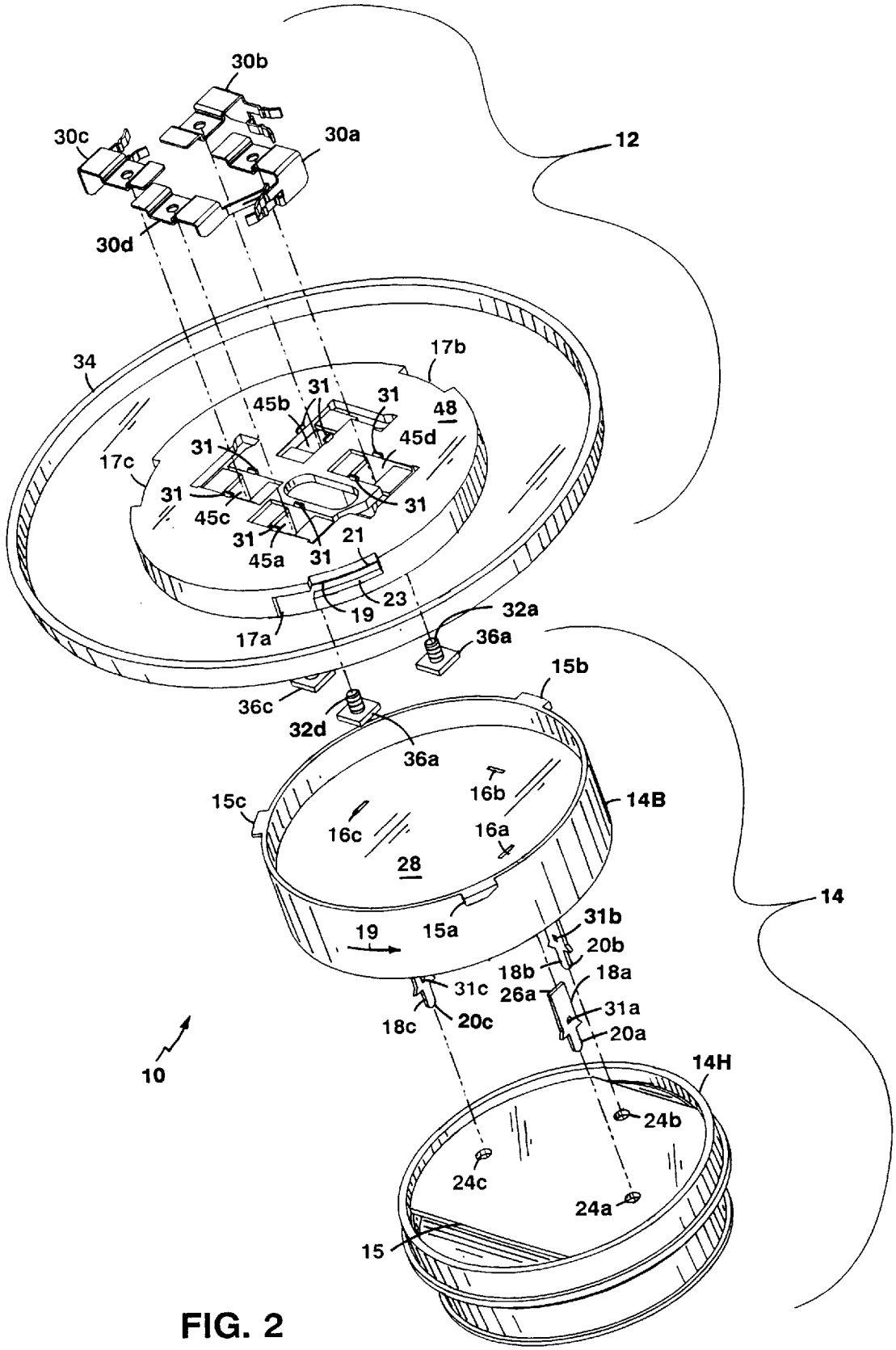
Figure 6:
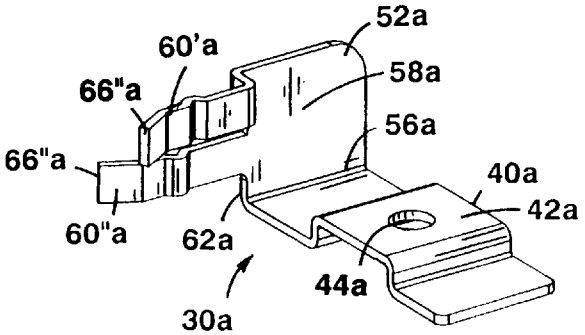
FIGS. 3, 4, 5 and 6 are views of an exemplary one of a plurality of electrical contacts included in a base section of the detector of FIGS. 1 and 2.
Figure 3:
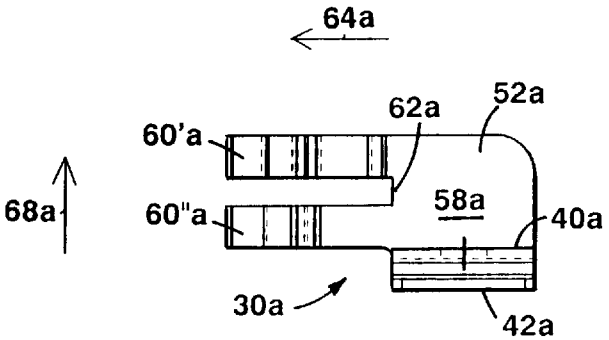
Figure 4:
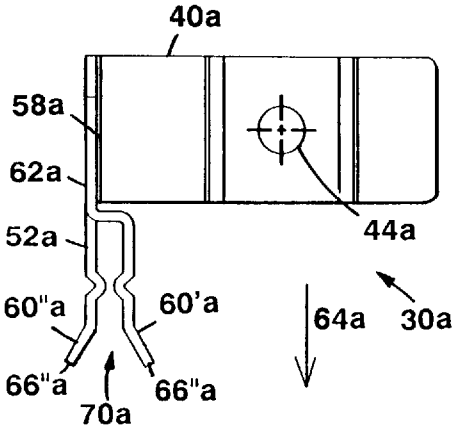
Figure 5:
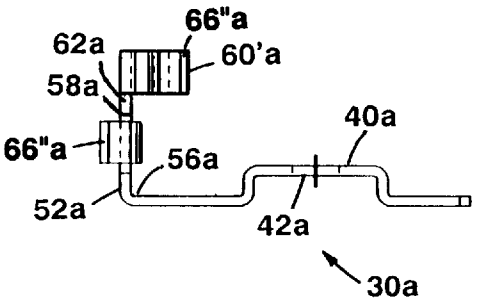

Referring now to FIGS. 1 and 2, a smoke/fire detector assembly 10 is shown. The assembly 10 includes a base section 12 and a removable/attachable sensor section 14.

The sensor section 14 includes a sensor head 14H and a removable/attachable sensor base 14B, both of dielectric material, here plastic. The sensor head 14H is of conventional design to encloses a smoke/fire detection element, not shown, such as an ionization, photo-optical or heat sensor. The smoke/fire detection element, not shown, and other electronic components, not shown, are electrically interconnected and mounted, in a conventional manner, by a printed circuit board 15 (FIG. 2). The printed circuit board 15, with its mounted smoke/fire detection element, not shown, and other electrical components, not shown, is mounted to the sensor head 14H in a conventional manner. The sensor head 14H is attachable/removable from the sensor base 14B in any conventional manner in order enable replacement of one type of smoke/fire detection element with another type, or to enable replacement of the sensor head 14H when it becomes defective.

The sensor base 14B is removable from, and reattachable to, the base section 12. Here, the sensor base 14B has three spade shaped male electrical contacts 18*a*, 18*b*, 18*c*, respectively, as indicated. The male electrical contacts 18*a*, 18*b*, 18*c* are a stamped, single piece of electrically conductive material, here phosphor bronze. More particularly, the three spade shaped male electrical contacts 18*a*, 18*b*, 18*c* are inserted through slots 16*a*, 16*b*, 16*c*, respectively, as indicated. Ends 20*a*, 20*b*, 20*c* of the electrical contacts 18*a*, 18*b*, 18*c*, respectively, protrude from surface 22 (FIG. 1) of sensor base 14B, pass through holes 24*a*, 24*b*, 24*c* (FIG. 2) respectively, formed in the printed circuit board 15, and plug into female electrical receptacles, not shown, mounted to the printed circuit board 15 for electrical connection to the smoke/fire detection element, not shown. The other ends 26*a*, 26*b*, 26*c* of electrical contacts 18*a*, 18*b*, 18*c*, respectively, protrude from surface 28 (FIG. 2) and are adapted to plug into base section 12 female electrical contacts 30*a*, 30*b*, 30*c*, respectively, in a manner to be described below. The mid-portion of electrical contacts 18*a*, 18*b*, 18*c*, are provided with detents 31*a*, 31*b*, 31*c*, respectively, which project outwardly from the surfaces of the electrical contacts 18*a*, 18*b*, 18*c*, as shown more clearly in FIG. 14*a* for detent 31*c*. These detents 31*a*, 31*b*, 31*c* are inserted into slots 35 formed in the sensor base 14B. Thus, each one of the electrical contacts 18*a*, 18*b*, 18*c* is disposed in the sensor base 14B of the sensor section 14 and projects longitudinally from such sensor section 14, here vertically from the sensor section 14, as shown.

Base section 12 includes: a dielectric, here plastic, mounting plate 34 adapted for mounting, in a conventional manner, to a ceiling, wall or other building structural member, not shown; the plurality of electrical contacts 30*a*, 30*b*, 30*c* which correspond, and electrically interconnect with, electrical contacts 18*a*, 18*b*, 18*c*, respectively; an additional electrical contact 30*d*; and screws 32*a*, 32*b*, 32*c*, 32*d*, respectively, and washers 36*a*, 36*b*, 36*c*, 36*d*, respectively, as shown, for affixing to electrical wires, not shown. Thus, screws 32*a*, 32*b*, 32*c* provide electrical terminal for the assembly 10. The electrical contacts 30*a*, 30*b*, 30*c*, 30*d* snap onto the bottom of conductors the electrical contacts 30*a*, 30*b*, 30*c*, 30*d*, respectively, to the bottom surface 48 (FIG. 2) of the base 12 by retaining snaps 31 which engage opposite surfaces of each one of the contacts 30*a*, 30*b*, 30*c*, 30*d*, as indicated in FIG. 2.

The base section 12 electrical contacts 30*a*, 30*b*, 30*c* which correspond, and electrically connect, to sensor section 14 electrical contacts 18*a*, 18*b*, 18*c* (FIGS. 1 and 2), are identical in construction. Here, each of the electrical contacts 30*a*, 30*b*, 30*c* is a stamped, single piece of electrically conductive material, here phosphor bronze. An exemplary one thereof, here electrical contact 30*a*, is shown in detail in FIGS. 3, 4, 5 and 6. Thus, each one of the electrical contacts 30*a*, 30*b*, 30*c*, has a first section 40*a*, 40*b*, 40*c*, respectively, with a surface 42*a*, 42*b*, 42*c* adapted for mounting to the mounting plate 34. More particularly, the first sections 40*a*, 40*b*, 40*c*, respectively, snap onto the mounting plate 34 by snaps 31(FIG. 2) which snap onto opposing surface porions of the electrical contacts. More particularly, the surfaces 42*a*, 42*b*, 42*c* contact ledges of recessed pockets 45*a*, 45*b*, 45*c* (FIG. 2) formed, along with the snaps 31, into mounting plate 34. Further, the first sections 40*a*, 40*b*, 40*c*, each has a threaded hole 44*a*, 44*b*, 44*c*, respectively, to receive screws 32*a*, 32*b*, 32*c*, 32*d*. As noted above, the screws 32*a*, 32*b*, 32*c* provide an electrical terminal for connecting to the building wiring, not shown, to provide electrical power to the detector assembly 10 and smoke/fire detection signals from the detector element, not shown, to a remotely located monitoring station, not shown.

Figure 7:
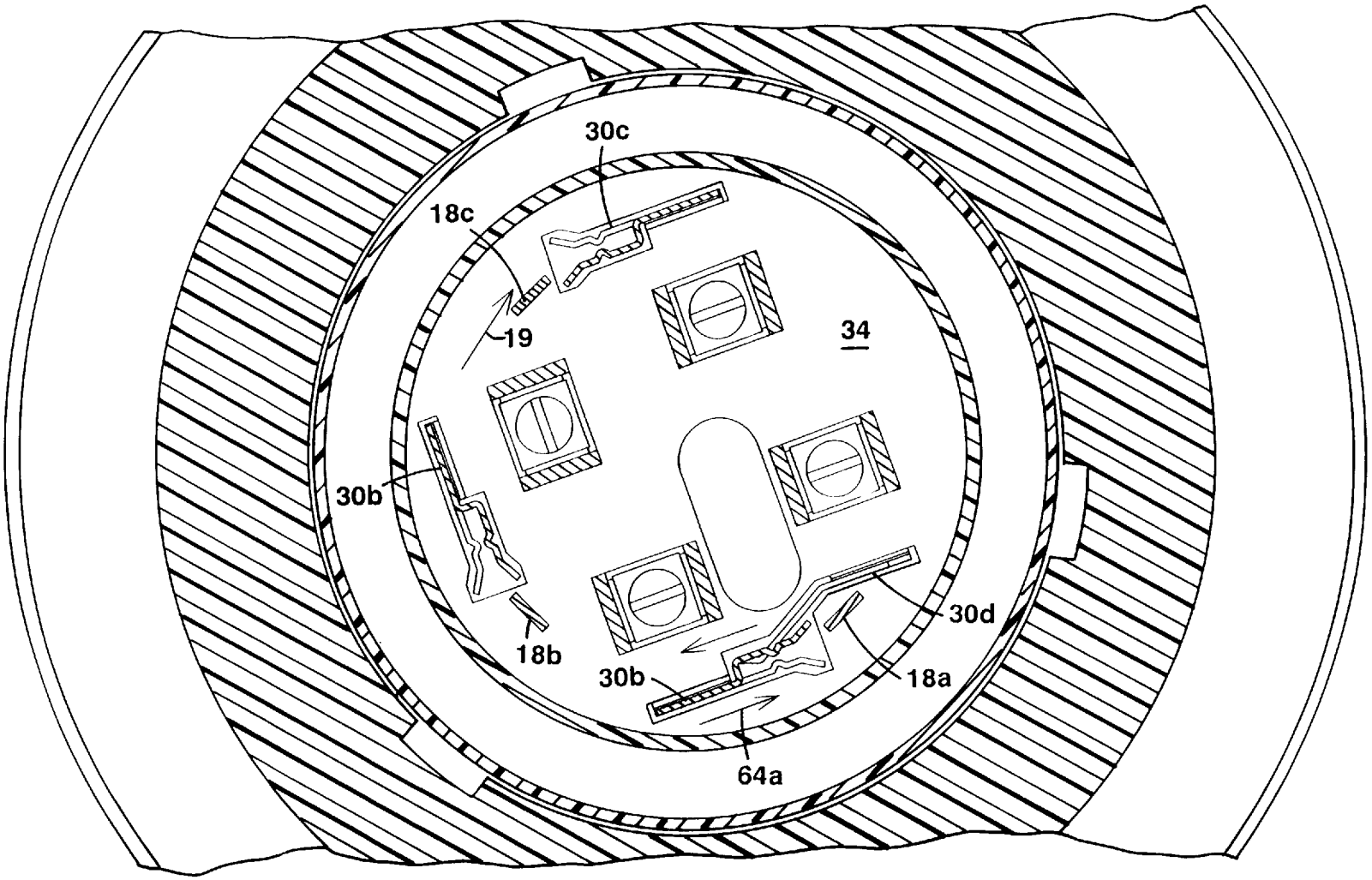
FIG. 7 is a plan view showing the relationship between electrical contacts of a sensor section of the detector of FIGS. 1 and 2 and the electrical contacts of the base section prior to such contacts becoming electrically connected.
Figure 8:
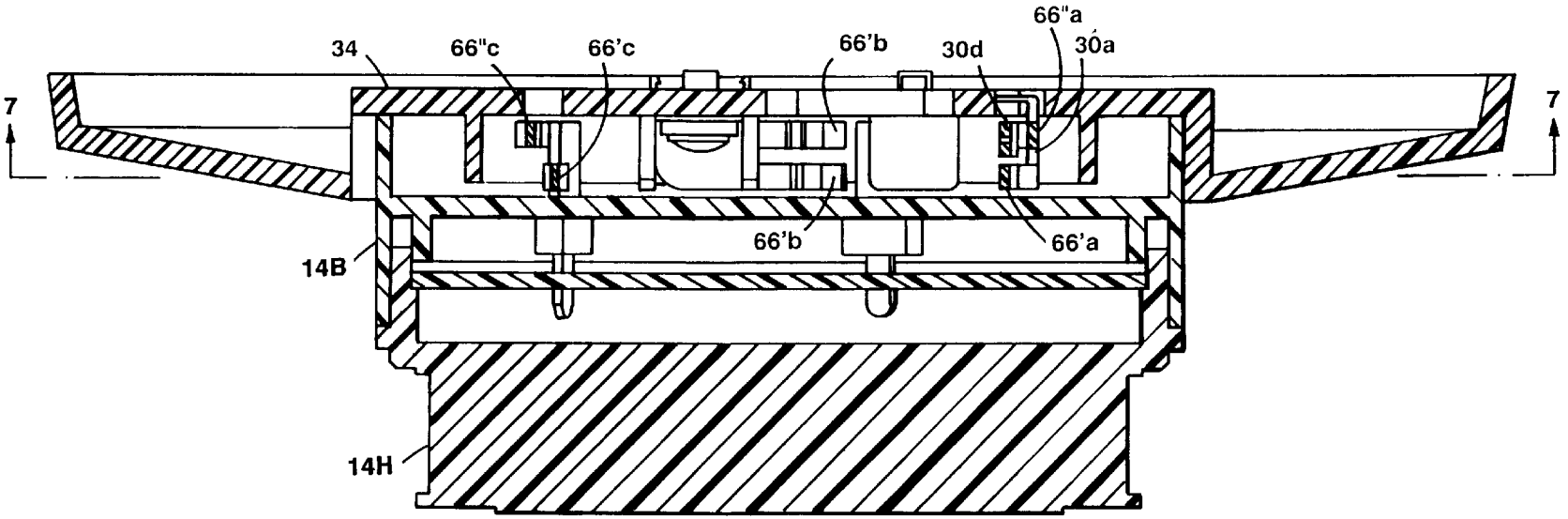
FIG. 8 is a elevation view showing the relationship between electrical contacts of the sensor section of the detector of FIGS. 1 and 2 and the electrical contacts of the base section prior to such contacts becoming electrically connected.
Figure 12:
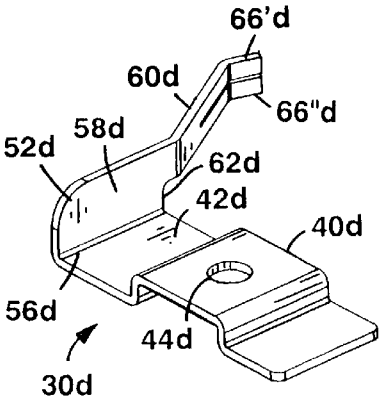
FIGS. 9, 10, 11, and 12 are views of an additional electrical contact included in a base section of the detector of FIGS. 1 and 2.
Figure 9:
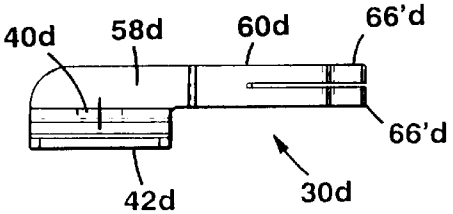
Figure 10:
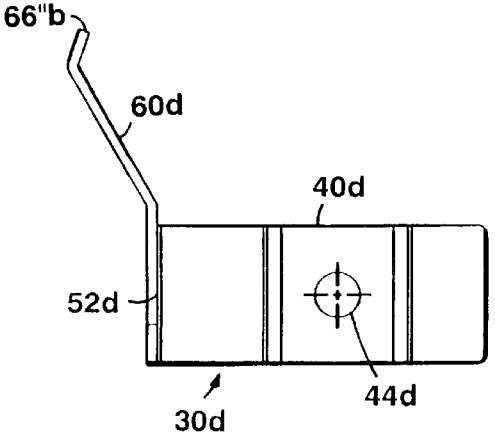
Figure 11:
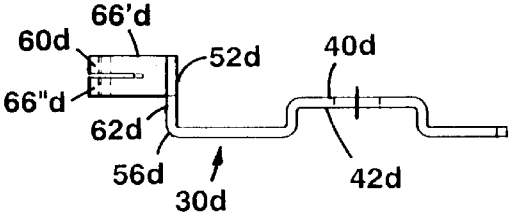

Each one of the base section 12 electrical contacts 30*a*, 30*b*, 30*c* also has a second section 52*a*, 52*b*, 52*c*, respectively. The first sections 40*a*, 40*b*, 40*c* and the second section 52*a*, 52*b*, 52*c* have a common edge 56*a*, 56*b*, 56*c*, respectively, as shown. Each of the electrical contacts 30*a*, 30*b*, 30*c* has a surface 58*a*, 58*b*, 58*c*, respectively, extending perpendicular to surface 42*a*, 42*b*, 42*c*, respectively, as shown, and a pair of finger-like members, 60'*a*, 60"; 60'*b*, 60"*b*; 60'*c*, 60"*c*, respectively, extending from a second edge 62*a*, 62*b*, 62*c*, respectively, of the second section 52*a*, 52*b*, 52*c*, respectively, as shown. The second edge 62*a*, 62*b*, 62*c*, of the second section 52*a*, 52*b*, 52*c*, respectively, is perpendicular to the common edge 56*a*, 56*b*, 56*c*, of the first and second sections 40*a*, 52*a*, 40*b*, 52*b*, 40*c*, 52*c*, respectively. The finger-like members 60'*a*, 60"*a*; 60'*b*, 60"*b*; 60'*c*, 60"*c* are laterally spaced along, and cantilevered from, the second edge 62*a*, 62*b*, 62*c*, of the second section 52*a*, 52*b*, 52*c*, respectively. The finger-like members 60'*a*, 60"*a*; 60'*b*, 60"*b*; 60'*c*, 60"*c* extend along a common direction 64*a*, 64*b*, and 64*c*, respectively, as shown. Distal ends 66'*a*, 66"; 66'*b*, 66"*b*; 66'*c*, 66"*c* of the finger-like members 60'*a*, 60"*a*; 60'*b*, 60"*b*; 60'*c*, 60"*c*, respectively, are spaced from each other laterally in a direction 68*a*, 68*b*, 68*c*, respectively, as shown, perpendicular to the common direction common direction 64*a*, 64*b*, 64*c*, respectively, as shown, to receive, in spaces 70*a*, 70*b*, 70*c*, and contact opposing surfaces of the first end 26*a*, 26*b*, 26*c*, of electrical contact 18*a*, 18*b*, 18*c*, respectively, as shown in FIGS. 7 and 8. Thus, each electrical interconnection is made by a bifurcated contact. That is, each base section electrical contact 30*a*, 30*b*, 30*c* makes physical contact with two points on opposing surfaces of the mating sensor section 14 electrical contact 18*a*, 18*b*, 18*c*, respectively, improving mechanical stability compared with an arrangement making contact with only two points on the same surface of a mating electrical contact.

The additional base section 12 electrical contact 30*d*, shown in detail in FIGS. 9, 10, 11 and 12, is provided to engage, together with one of plurality of base section 12 electrical contacts, here sensor section 12 electrical contact 20*a*, a common one of the sensor section 14 electrical contacts, here sensor section 14 electrical contact 18*a*, as shown. Thus, sensor section 14 electrical contact 18*a* is contacted by two base section electrical contacts, here electrical contact 30*a* and electrical contact 30*d*.

The additional electrical contact 30*d* is a stamped, single piece of electrically conductive material, here phosphor bronze, and includes a first section 40*d* with a surface 42*d* adapted for mounting to the mounting plate 34 (FIGS. 1 and 2). More particularly, the first section 40*d* has a threaded hole 44*d* to receive, and thereby become secured to the base section 12, screws 32*d* (FIGS. 1 and 2). More particularly, the surface 42*d* contacts ledge of recessed pocket 45*d* (FIG. 2) formed in surface 48 mounting plate 34 and are affixed in place with screw 32*d* and washers 36*d* from the opposite surface 50 (FIG. 1) of the mounting plate 34. The screw 32*d* is are also used to provide an electrical terminal for connecting to the building wiring, not shown.

Electrical contact 30*d* also has a second section 52*d*. The first section 40*d* and the second section 52*d* have a common edge 56*d*, as shown. The electrical contact 30*d* has a surface 58*d* extending perpendicular to surface 42*d*, as shown, and a finger-like member 60*d* extending from a second edge 62*d* of the second section 52*d*, as shown. The second edge 62*d* of the second section 52*d* is perpendicular to the common edge 56*d* of the first and second sections 40*d*, 52*d*. The finger-like member 60*d* is cantilevered from the second edge 62*d* of the second section 52*d*. The finger-like member 60*d* extends is a direction opposite to direction 64*a* of contact 30*a*. The distal end of the finger-like member 60*d* of the additional base section 12 electrical contact 30*d* is bifurcated to provide two distal ends 66'*d*, 66"*d*, to make contact with two points on the same surface of the sensor section 14 electrical contact 18*a*, the opposite surface of such sensor section 14 electrical contact 18*a* being contacted by the pair of finger-like members 60'*a*, 60"*a* of base section 12 electrical contact 30*a*.

Figure 13:
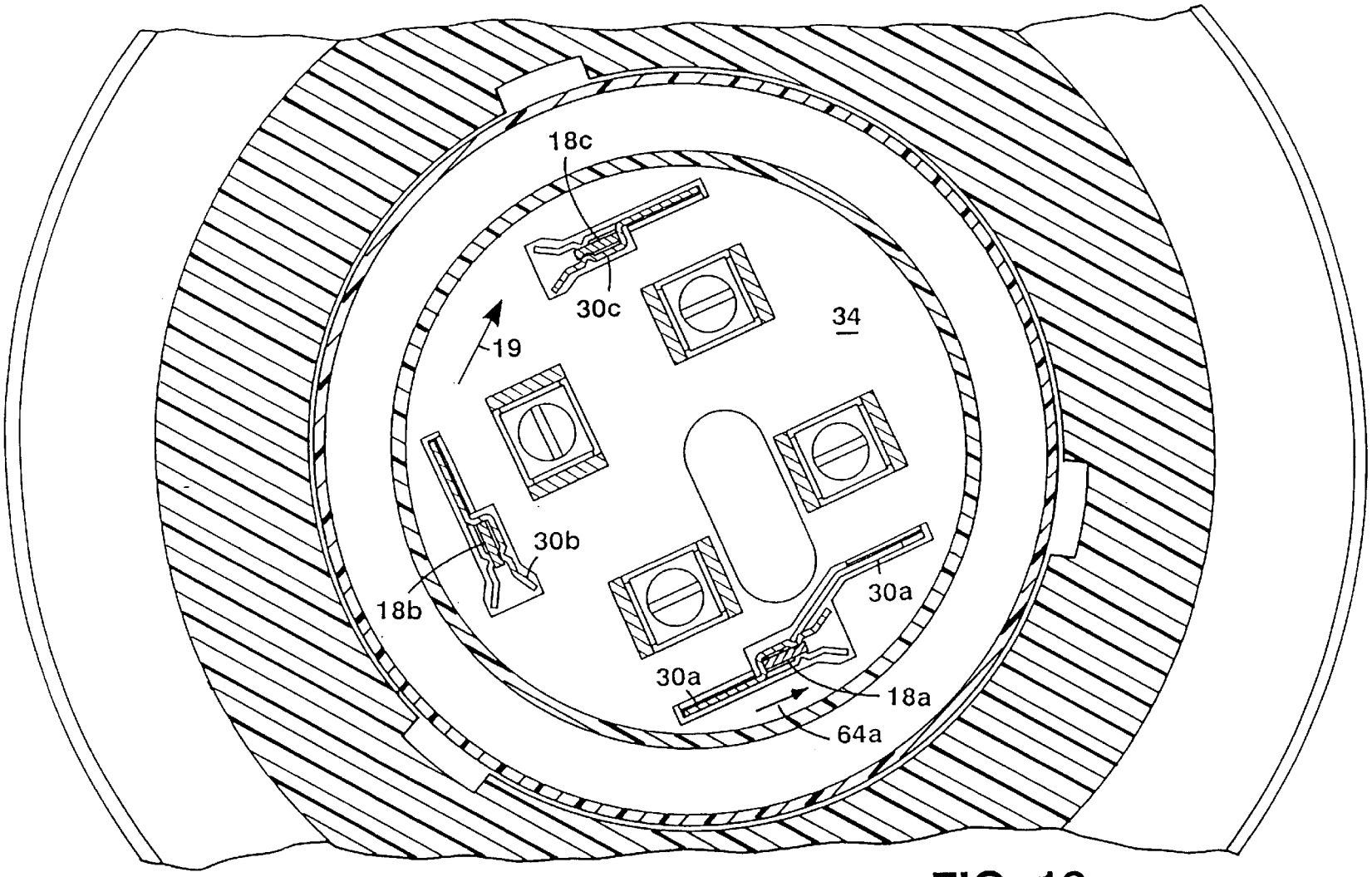
FIG. 13 is a plan view showing the relationship between electrical contacts of a sensor section of the detector of FIGS. 1 and 2 and the electrical contacts of the base section after such contacts become electrically connected.
Figures 14, 14A:
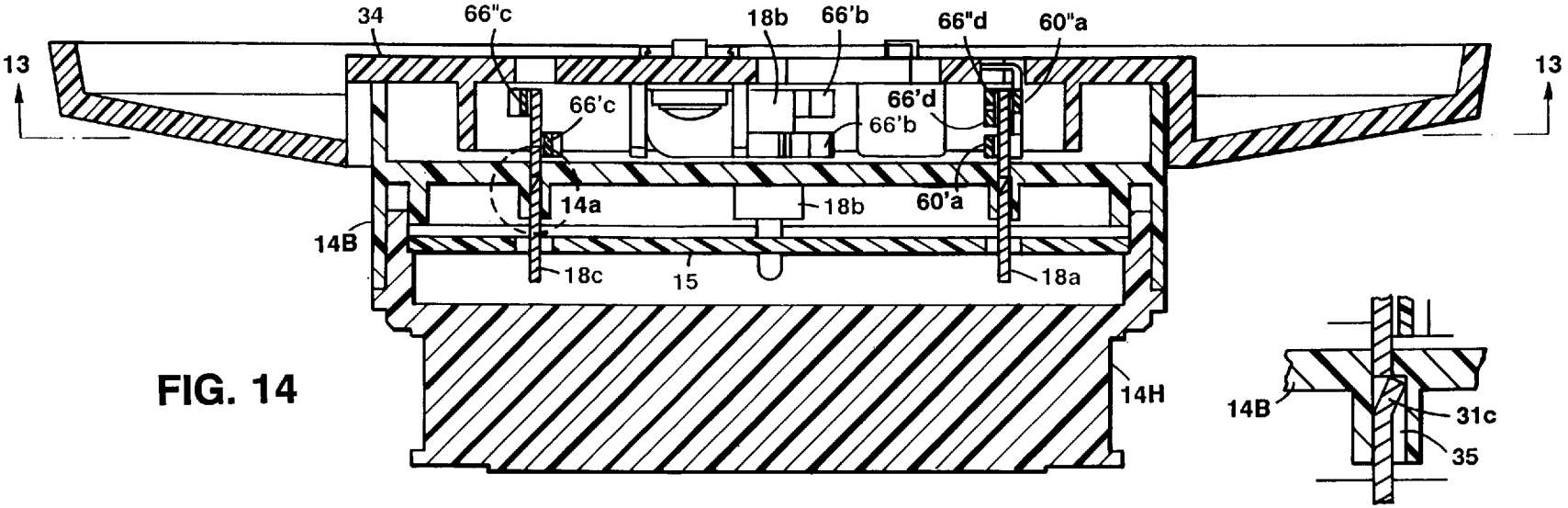
FIG. 14 is a elevation view showing the relationship between electrical contacts of the sensor section of the detector of FIGS. 1 and 2 and the electrical contacts of the base section after such contacts become electrically connected; and, FIG. 14*a* is a elevation view of the portion of FIG. 14 enclosed by a circle labelled 14*a*.
Figure 18:
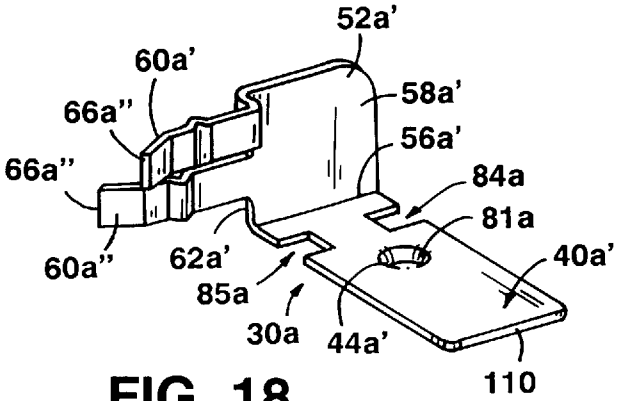
FIGS. 15, 16, 17 and 18 are views of an exemplary one of a plurality of electrical contacts according to the invention.
Figure 15:
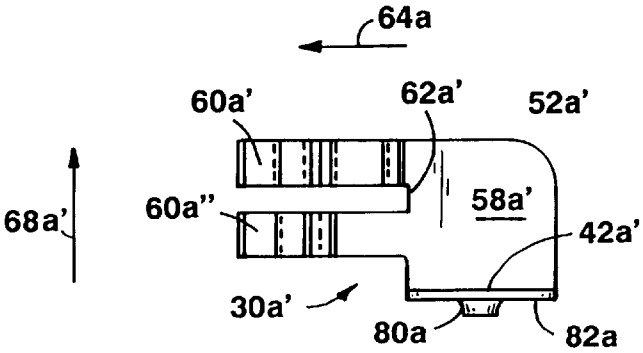
Figure 16:
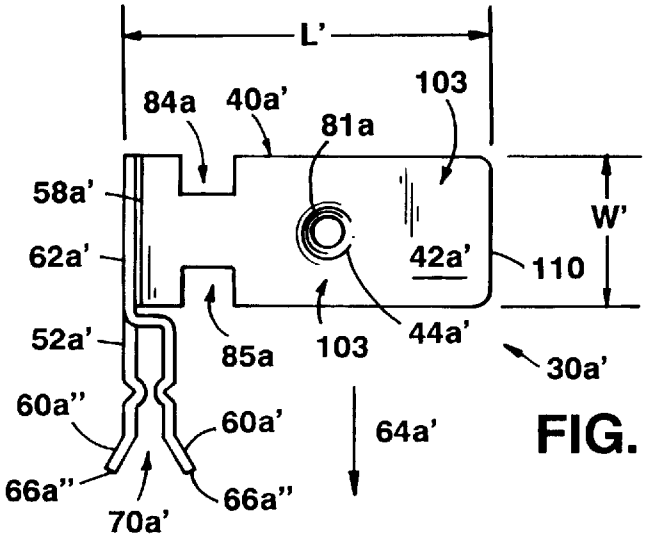
Figure 17:
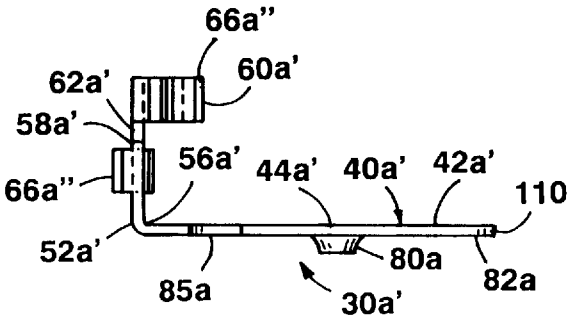

As noted above, the sensor base 14B is attachable to/removable from the base section 12. More particularly, and referring again to FIGS. 1 and 2, the sensor base 14B is formed with three tabs 15*a*, 15*b*, 15*c*, adapted to be inserted into slots 17*a*, 17*b*, 17*c* formed in the mounting plate 34. Further, as noted above in connection with FIGS. 3–6, distal ends 60'*a*, 60"*a* are laterally displaced along surface 58*a*. Thus, a shown in FIG. 13, distal end 60*d* of contact 30*d* and distal end 62'*a* of contact 30*a* are in a vertical, overlaying relationship, while distal end 60"*a* of contact 30*a* and distal end 60*d* of contact 30*d* are disposed in a lateral relationship, as shown. When inserted into slots 17*a*, 17*b*, 17*c*, the base electrical contacts 18*a*, 18*b*, 18*c* become positioned to slide into the space 70*a*, 70*b*, 70*c* between distal ends 66'*a*, 66"*a*, 66'*b*, 66"*b*, 66'*c*, 66"*c*, respectively, as indicated in FIGS. 13 and 14. Once inserted, the sensor base 14B is rotated in the direction indicated by arrow 19 so that the tabs 15*a*, 15*b*, 15*c*, slide into receiving pockets 21, in an inter-locking arrangement, to thereby lock the sensor base 14B to lock the base section 12. Further, when rotated, the contact 18*a*, 18*b*, 18*c* slide into the spaces 70*a*, 70*b*, 70*c*, respectively of contacts 30*a*, 30*b*, 30*c*, respectively. More particularly, when rotated, the leading edge of contacts 18*a*, 18*b*, 18*c* engage the distal ends 66'*a*, 66"*a*, 66'*b*, 66"*b*, 66'*c*, 66"*c*, respectively, urging them further apart by camming action while maintaining physical contact with the opposing surfaces of the contacts 18*a*, 18*b*, 18*c*, respectively, because of the resiliency of the cantilevered finger-like contacts 30*a*, 30*b*, 30*c*, 30*d*. Thus, distal ends 66"*a*, 66'*a* contact upper and lower portions, respectively, as shown in FIG. 8, of opposing surfaces, here right and left sides. respectively, of contact 18*a* and distal ends 66'*d*, 66"*d* of contact 30*d* contact two adjacent portions of the left upper surface of contact 18*a*, as shown. Distal ends 66"*c*, 66'*c* contact opposing surfaces of contact 18*c*, and, likewise distal ends 66"*b*, 66'*b* contact opposing surfaces of contact 18*b*, as shown 8. Reversing the rotation process enables the sensor base 14B to be removed from the mounting plate 34.

It should be noted that the attachment of the base and sensor sections 12, 14 are, here preferably performed by robotics (i.e.; automation) type assembly equipment. It is noted that, using vertically extending electrical contacts for the sensor section 14 enables such sensor section 14 to be robotically inserted into a sensor section 14 test fixture, not shown. The tested sensor section 14 may be robotically removed from the test fixture, and then, if successfully tested, robotically attached to a corresponding base section 12.

Referring now to FIGS. 15–18, an exemplary one of the base section electrical contacts 30*a*, 30*b*, 30*c* (FIGS. 1 and 2), is shown modified in accordance with the invention. It should be understood that while only modified contact 30'*a* is shown, the other contacts 30*b*, and 30*c* would also be modified to that shown for contact 30'*a* (FIGS. 15–18). The electrical contact 30'*a* is here again a stamped, single piece of electrically conductive material, here phosphor bronze. The electrical contact 30'*a* has a first section 40'*a* with a surface 42'*a* adapted for snapping into recessed pocket 45'*a* of a mounting plate modified in accordance with the invention, here to mounting plate 34' shown, and to be described in detail, in connection with FIGS. 19–21.

More particularly, and referring again to FIGS. 15–18, the first section 40'*a* has a threaded hole 44*a*' hole formed therethrough to receive screw 32*a*, as described above in FIGS. 1 and 2. The hole 44'*a* is formed with a dimple 81*a* into the upper surface 42'*a* of first section 40'*a*. It is noted that the dimple 81*a* creates projection or rim 80*a* which projects from the bottom surface 82*a* of the first section 40'*a*. Further, the first section 42'*a* has a pair of opposing open-ended (or U-shaped) slots 84*a*, 85*b* formed in side edges of section 40'*a*, as shown. The remaining portion of the electrical contact 30'*a* is the same as electrical contact 30*a* described above in connection with FIGS. 3–6. Thus, the electrical contact 30'*a* has a second section 52'*a*. The first section 40'*a* and the second section 52'*a* have a common edge 56'*a*, as shown. The electrical contact 30'*a* has a surface 58'*a* extending perpendicular to surface 42'*a*, as shown, and a pair of finger-like members, 60'*a*, 60*a*" extending from a second edge 62'*a* of the second section 52'*a*, as shown. The second edge 62'*a* of the second section 52'*a* is perpendicular to the common edge 56'*a* of the first and second sections 40'*a*, 52'*a*. The finger-like members 60'*a*, 60"*a* are laterally spaced along, and cantilevered from, the second edge 62'*a* of the second section 52'*a*. The finger-like members 60'*a*, 60"*a* extend along a common direction 64'*a*, as shown. Distal ends 66'*a*, 66*a*" of the finger-like members 60'*a*, 60"*a* are spaced from each other laterally in a direction 68'*a*, as shown, perpendicular to the common direction common direction 64'*a*, as shown, to receive, in space 70'*a* and contact opposing surfaces of the first end 26*a* of electrical contact 18*a* (FIGS. 1 and 2).

Figure 19:
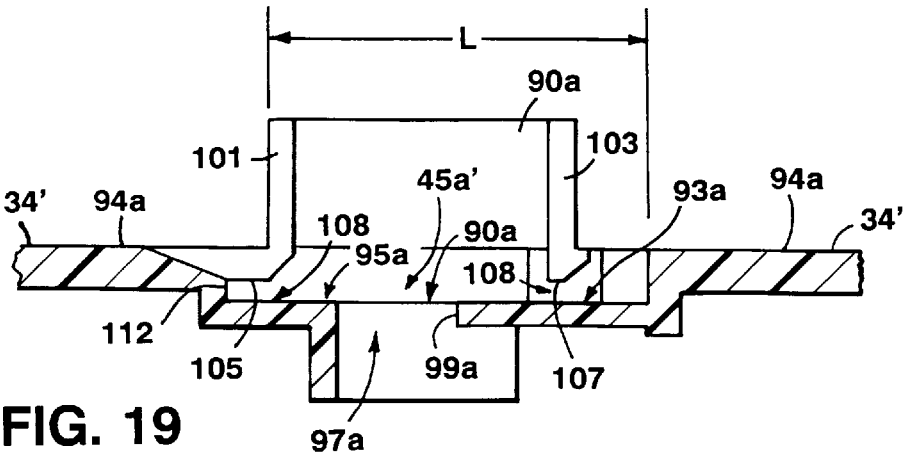
FIGS. 19–21 are partially broken away views of a mounting plate according to the invention, such mounting plate having a recessed pocket formed therein adapted to have snapped therein the electrical contact of FIGS. 15–18.
Figure 20:
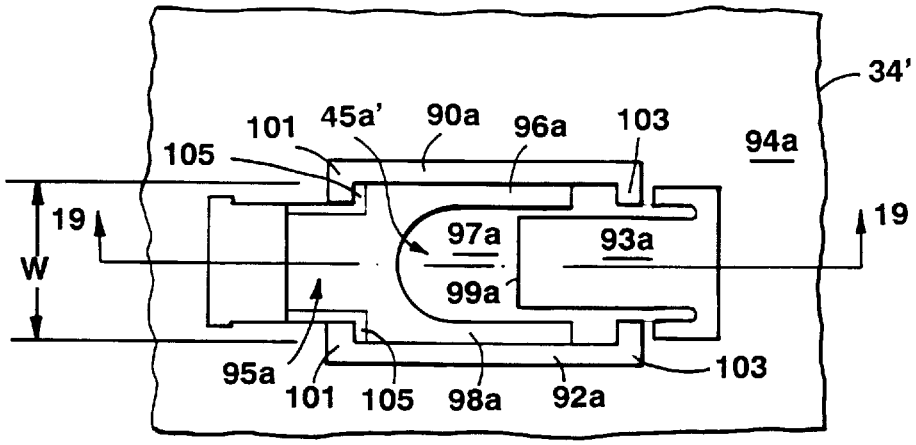
Figure 21:
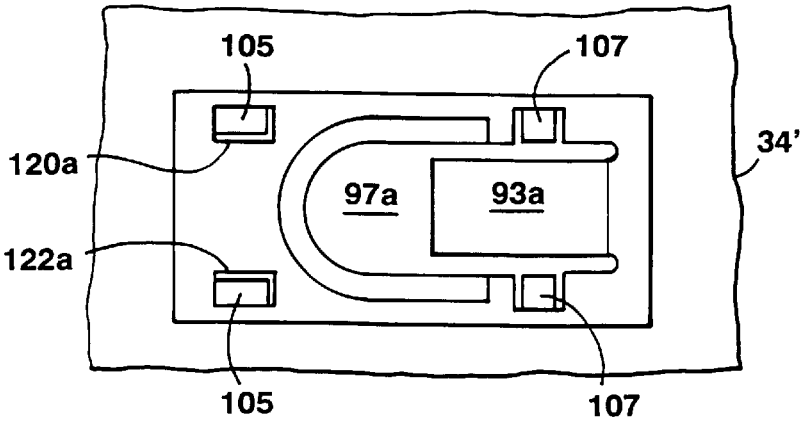
Figure 25:
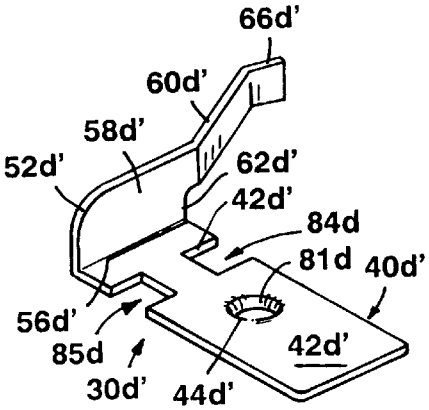
FIGS. 22, 23, 24, and 25 are views of an additional electrical contact according to the invention.
Figure 22:
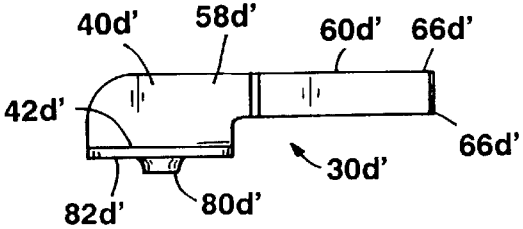
Figure 23:
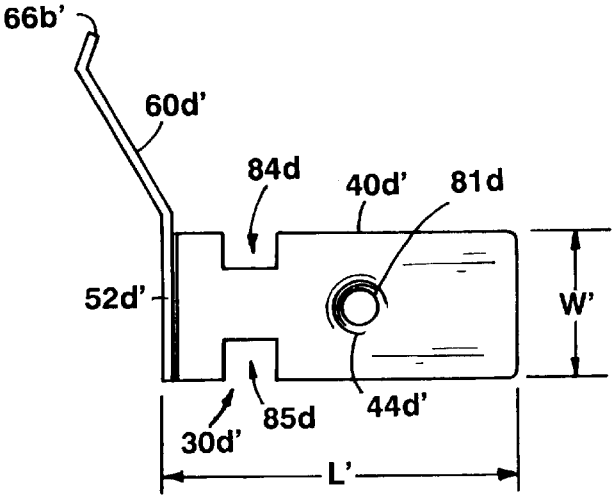
Figure 24:
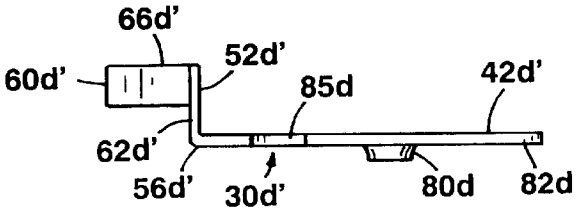

The additional electrical contact 30'*d* shown in FIGS. 22–25 is again a stamped, single piece of electrically conductive material, here phosphor bronze, and includes a first section 40'*d* with a surface 42'*d* identical to the first section 40'*a* of the contact 30'*a* shown and described above in connection with FIGS. 15–18 and is adapted for mounting to the mounting plate 34' (FIGS. FIGS. 19–21). More particularly, the first section 40'*d* has a threaded hole 44'*d* formed with a dimple 81*d* into the upper surface 42'*d* of first section 40'*d*. It is noted that the dimple 81*d* creates projection, or rim 80*d* which projects from the bottom surface 82*d* of the first section 40'*d*. Further, the first section 42'*d* has a pair of opposing open-ended (or U-shaped) slots 84*d*, 85*d* formed in edges thereof, as shown. Thus, the first sections 40'*a* and 40'*d* are identical in construction and configuration. The remaining portion of the electrical contact 30'*d* is the same as electrical contact 30*d* described above in connection with FIGS. 3–6. Thus, the electrical contact 30'*d* has a second section 52'*d*. The first section 40'*d* and the second section 52'*d* have a common edge 56'*d*, as shown. The electrical contact 30'*d* has a surface 58'*d* extending perpendicular to surface 42'*d*, as shown, and a finger-like member 60'*d* extending from a second edge 62'*d* of the second section 52'*d*, as shown. The second edge 62'*d* of the second section 52'*d* is perpendicular to the common edge 56'*d* of the first and second sections 40'*d*, 52'*d*. The finger-like member 60*d* is cantilevered from the second edge 62'*d* of the second section 52'*d*. The finger-like member 60'*d* extends is a direction opposite to direction 64'*a* of contact 30'*a*. The distal end of the finger-like member 60'*d* is not however bifurcated.

Referring now again to FIGS. 19–21, the modified mounting plate 34' is again plastic, here however, formed with a pair of opposing bracket-shaped side walls 90*a*, 92*a* which project perpendicular to surface 94*a*, as shown in FIGS. 19 and 20. The recessed pocket 45'*a* is formed with a C-shaped platform 95*a* having a pair of opposing, spaced ledges 96*a*, 98*a*, terminating along inner lower edges of the side walls 90*a*, 92*a*, as shown, and a tongue-like member, or cantilevered protrusion 93*a* having a distal end 99*a* which projects into the opening 97*a* formed in the central region of the C-shaped platform 95*a*, as shown. It is noted that the platform 95*a* and protrusion 99*a* have upper surfaces disposed in a common plane and that such plane is spaced from, i.e., recessed below, the upper surface 94*a* of the mounting plate 34'. More particularly, it is noted that the sidewalls 90*a*, 92*a* have end walls 101, 103 with bottom portions 105, 107 terminating along surfaces which are parallel to the above-mentioned common plane but which are spaced above such common plane to provide a slot, or channel 108 between: (a) the upper surfaces of the platform 108 and protrusion 99*a*; and, (b) the bottom portions 105, 107 of the sidewalls 90*a*, 92*a*. The channel 108 has a terminating edge 112, as shown. For reasons to become apparent in connection with FIGS. 26–31, it should be noted that: (a) the bottom portions 105, 107 are tapped along a surface which faces away from edge 112, as shown; (b) the length, L, of the channel 108 is here longer than the length, L', of the contact 30'*a*; and, (c) the width, W, between the inner opposing surfaces of sidewalls 90*a*, 92*a* is substantially equal to, but slightly greater than, the width, W', of the contact 30'*a*.

It is also noted that L-shaped slots 120*a*, 122*a* (FIG. 21) are provided. The slots 120*a*, 122*a*, are formed by rectangular shaped openings formed through the platform 95*a*, as shown in FIG. 21, exposing the bottom portions 105 of the side walls 90*a*, 92*a*. Likewise, rectangular openings are formed in the platform to expose the bottom portions 107 of the sidewalls 90*a*, 92*a*. That is the bottoms are disposed over the openings, as shown in FIG. 21.

Figure 26:
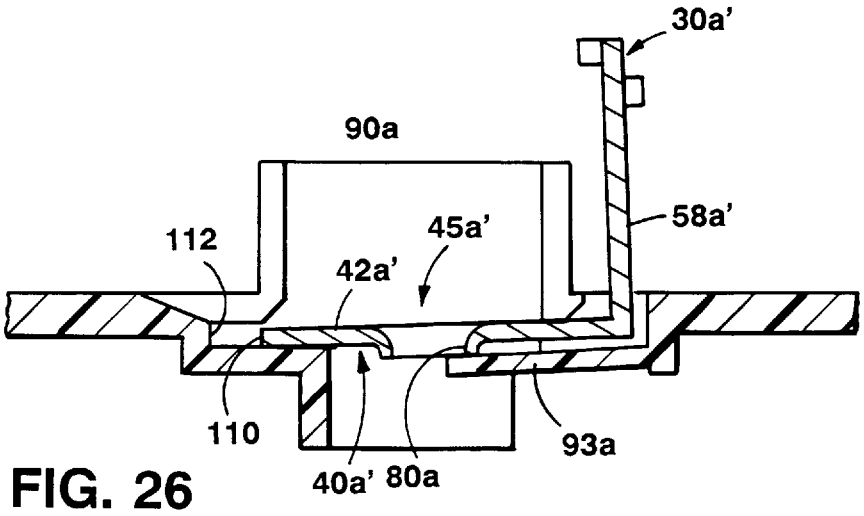
FIGS. 26, 27 and 28 are partially broken away views of the mounting plate of FIGS. 19–21 with the contact of FIGS. 15–16 partially inserted into the pocket.
Figure 27:
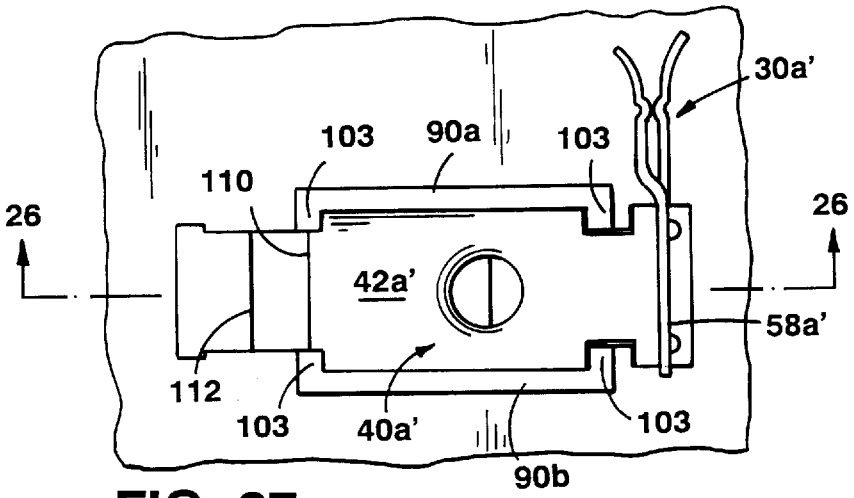
Figure 28:
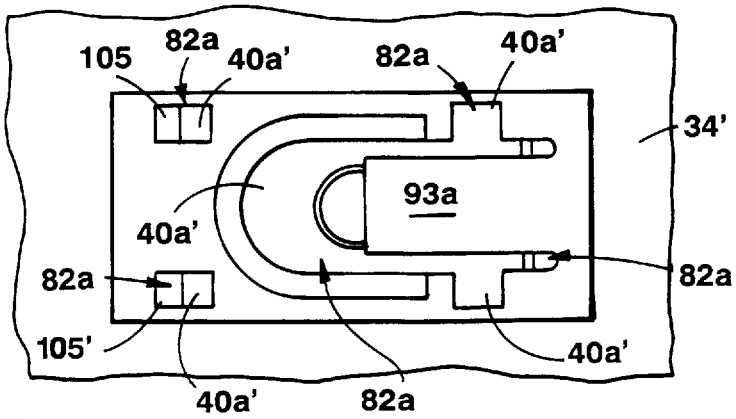

Referring now to FIGS. 26, 27 and 28, the initial engagement between one of the modified electrical contacts, here contact 30'*a* with the recessed pocket 45'*a* is shown. It is first noted that the U-shaped sidewalls 92*a*, 90*b* form a frame to enable the first section 42'*a* to sit on the tongue-like member or protrusion 93*a* and the C-shaped platform including the ledges 96*a*, 98*a* (FIG. 20). It is next noted that as the leading edge 110 of the first section 40'*a* slides into the channel 108, the projection or rim 80*a* depresses the resilient tongue-like, protrusion 93*a* downward, as shown, by camming action thereby enabling opposing side edge portions 103 of the first section 30'*a* to slip under the bottom portions of the sidewalls 90*a*, 90*b*, as indicated more clearly in FIG. 26.

Figure 29:
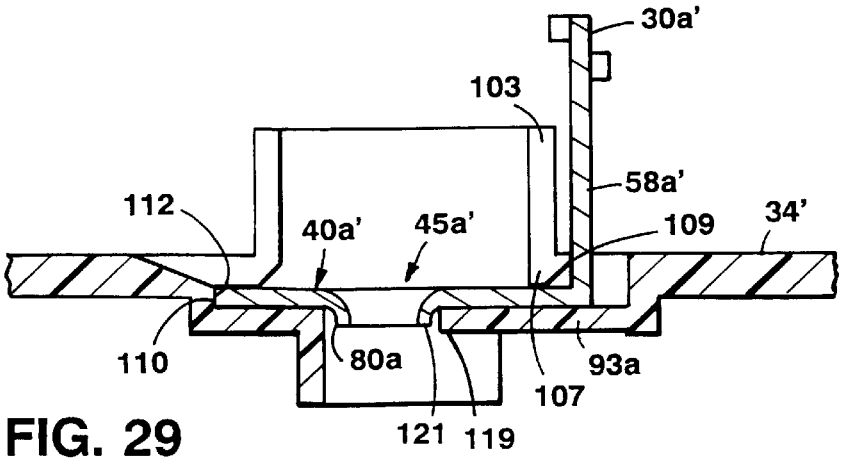
FIGS. 29, 30, and 31 are partially broken away views of the mounting plate of FIGS. 19–21 with the contact of FIGS. 15–16 being fully inserted into the pocket.
Figure 30:
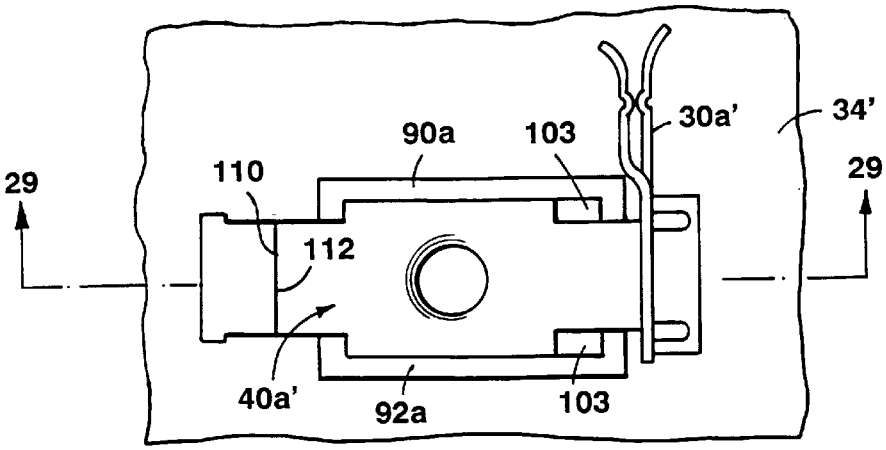
Figure 31:
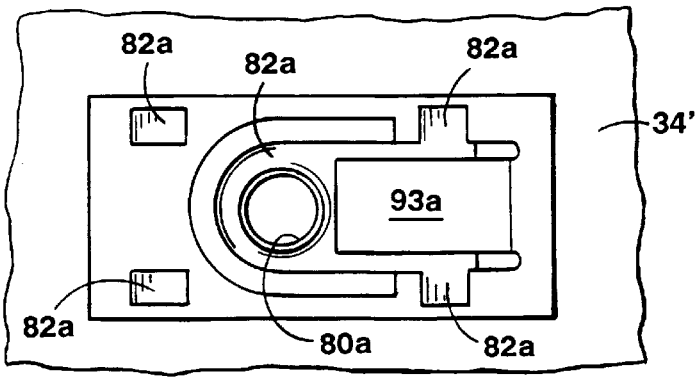

Referring now to FIGS. 29, 30 and 31, the electrical contact 30'*a* is shown fully inserted into the channel 108 (FIG. 19) with the forward edge 110 against the end of the channel 108 and the section 58'*a* against the forward portion 109 of the bottom portion 107 of endwall 103, as shown. The resilient tongue-like protrusion 93*a* wedges the first section upwardly against the bottom portions of the sidewalls 90*a*, 92*a* and the edge portion 119 of the tongue-like protrusion 93*a* snaps back of (i.e., behind the portion 121 of) the projection or rim 80*a* with an audible click and now the electrical contact 30'*a* is securely locked in place in the channel 108. That is, as shown in FIGS. 29, 30 and 31, the electrical contact 30'*a* is now securely snapped and locked into the recessed pocket 45'*a*.

Other embodiments are within the spirit and scope of the appended claims.

What is claimed is:

1. A smoke/fire detector assembly, comprising:

a base section having a plurality of electrical contacts;

a removable/attachable sensor section having a corresponding plurality of electrical contacts, each one thereof being adapted to electrically contact a corresponding one of the base section electrical contacts;

and wherein each one of the base section electrical contacts has a hole formed therein, said hole having a projecting rim disposed about a peripheral portion;

and wherein the base section has a plurality of recessed pockets formed therein, each one of said pockets having disposed therein a corresponding one of the plurality of base section electrical contacts, each one of said pockets having:

a pair of opposing sidewalls;

a platform and;

a resilient tongue-like member protruding into a region between the opposing sidewalls, upper surfaces of the platform and the tongue-like member being disposed in a common plane spaced from the bottom portions of the sidewalls to provide a channel therebetween.

2. A smoke/fire detector assembly, comprising:

a base section having a plurality of electrical contacts;

a removable/attachable sensor section having a corresponding plurality of electrical contacts, each one thereof being adapted to electrically contact a corresponding one of the base section electrical contacts;

and each one of the base section electrical contacts having a hole formed therein, said hole having a projecting rim disposed about a peripheral portion;

and wherein the base section has a plurality of recessed pockets formed therein, each one of said pockets having:

a pair of opposing sidewalls;

a platform and;

a resilient tongue-like member protruding into a region between the opposing sidewalls, upper surfaces of the platform and the tongue-like member being disposed in a common plane spaced from the bottom portions of the sidewalls to provide a channel therebetween and when engaged by a corresponding one of the base section electrical contacts, the tongue-like member being configured to depressed downward enabling side edge portions of said corresponding one of the base section electrical contacts to slide within the channel to urge the corresponding contact upward against the bottom portions of the sidewalls.

3. The assembly recited in claim 2 wherein an edge portion of the tongue-like member is configured to engage a portion of the rim to secure the corresponding one of the base section electrical contacts in the channel.

4. The assembly recited in claim 3 wherein the hole is threaded and adapted to receive a screw, said screw being adapted for fastening to an electrical wire.

* * * * *